US005661949A

United States Patent [19]

Blanc

[11] Patent Number: 5,661,949

[45] Date of Patent: Sep. 2, 1997

[54] AUTOMATIC PACKING DEVICE FOR THE FILLING OF CONTAINERS WITH SUPERIMPOSED LAYERS OF PRODUCTS

[75] Inventor: Philippe Blanc, Montauban, France

[73] Assignee: Materiel Pour l'Arboriculture Fruitiere, Montauban, France

[21] Appl. No.: 603,775

[22] Filed: Feb. 20, 1996

[30] Foreign Application Priority Data

Feb. 17, 1995 [FR] France ..... 95 01957

[51] Int. Cl.[6] ..... B65B 35/30

[52] U.S. Cl. ..... 53/237; 53/154; 53/244; 53/247; 53/495; 53/498; 53/537; 53/540; 53/543

[58] Field of Search ..... 53/154, 168, 237, 53/242, 243, 244, 246, 247, 495, 498, 500, 537, 538, 539, 540, 543

[56] References Cited

U.S. PATENT DOCUMENTS

| | | | |
|---|---|---|---|
| 2,938,315 | 5/1960 | Voullaire | 53/247 X |
| 3,292,341 | 12/1966 | Frost | 53/538 X |
| 3,453,802 | 7/1969 | Riddington . | |
| 3,465,495 | 9/1969 | Zwiacher et al. | 53/247 X |
| 3,590,551 | 7/1971 | Riddington et al. | 53/494 |
| 3,613,330 | 10/1971 | Voullaire | 53/247 X |
| 3,685,624 | 8/1972 | Paddock | 53/244 X |
| 3,928,942 | 12/1975 | Paddock et al. | 53/247 |
| 4,203,274 | 5/1980 | Warkentin et al. | 53/244 X |
| 4,277,932 | 7/1981 | Campbell | 53/543 X |
| 4,329,831 | 5/1982 | Warkentin et al. | 53/537 |
| 4,385,482 | 5/1983 | Booth | 53/538 |
| 4,386,491 | 6/1983 | Cramer et al. . | |
| 4,583,910 | 4/1986 | Borgman et al. . | |
| 4,712,818 | 12/1987 | Borgman et al. . | |
| 5,117,611 | 6/1992 | Heck et al. . | |

FOREIGN PATENT DOCUMENTS

| | | |
|---|---|---|
| 2 494 214 | 5/1982 | France . |
| 7708236 | 1/1978 | Netherlands . |

*Primary Examiner*—Daniel Moon
*Attorney, Agent, or Firm*—Young & Thompson

[57] ABSTRACT

An automatic packing device for the filling of containers with superimposed layers of products, in particular fruits such as oranges, comprises a transport device capable of dividing the flow of citrus fruits into two separate streams, two separate feed stations suited to arrange each stream of citrus fruits according to a predetermined distribution, a packing station, and gripping elements capable of gripping alternately a layer of citrus fruits square with each feed station, and of effecting their transfer towards the packing station. Each feed station comprises a conveyor belt (8, 9) extending along a descending slope, which is constructed to run in a longitudinal direction opposite to that in which the products are fed, and an interchangeable cradle (10, 11) whose form is suited to ensure that the products endowed with a rotating movement take up position inside the cradle.

18 Claims, 4 Drawing Sheets

40
41
43
44
42
37b
45
40
40
44
37b
36
41
B
B
35
45
37
37a
38
5
11
1
78
4
79
15
10
20
33
39
68
66
18
8
69
30
29
34
9
60
28
61a
55
58
59
58a
61
61b
62
47
64
48
50
49
52
51
53
41
43

AUTOMATIC PACKING DEVICE FOR THE FILLING OF CONTAINERS WITH SUPERIMPOSED LAYERS OF PRODUCTS

FIELD OF THE INVENTION

The invention relates to an automatic packing device for the filling of containers by means of superimposed layers of products, in particular fruits such as oranges.

BACKGROUND OF THE INVENTION

As described in particular in the patents U.S. Pat. No. 4,712,818, U.S. Pat. No. 4,583,910, U.S. Pat. No. 5,117,611, FR 2 494 214, NL 7708236 . . . , the current packing devices designed for the automatic filling of containers by means of superimposed layers of products, in particular fruits such as oranges, comprise mainly:

means for transporting the products which are capable, from a flow of products delivered in bulk, of dividing this flow into two separate streams, two separate feed stations suited to arranging each stream of products so that said products are aligned the ones behind the others in parallel rows, the products of each row, on a level with a feed station, being disposed in alternating positions relative to the products of the corresponding rows of the other feed station, a central packing station comprising means for positioning each container which are suited to provide support for said container for the purpose of filling it, gripping means capable of gripping alternately, square to each feed station, a number of products forming a layer with dimensions mating with the internal section of the container, and of placing this layer in said container so as to fill the latter by means of superimposed layers of products offset the ones relative to the others.

Such packing devices have the advantage of being completely automated and of exhibiting a high filling rate. In addition, the filling of the containers is performed by means of layers of products disposed so as to be perfectly offset the ones with respect to the others, and the risk of damage to these products, particularly when the latter consist in fruits, during the handling and transport of the containers, is therefore dispelled.

These packing devices nevertheless have a major drawback resulting from the tiresome operations that have to be carried out on the occasion of a change in the size of products for packing, which change frequently arises when these products consist of fruits, such as oranges, that are sorted beforehand as a function in particular of their size. Although in fact certain devices, in particular those described in the patent U.S. Pat. No. 4,712,818, are provided with fixing devices permitting the rapid fitting and dismantling of a chamber bearing the gripping members, for the purpose of adapting the distribution of these gripping members to the distribution of the products as a function of their size, the operations for modifying the feed stations are for their part tiresome.

These feed stations comprise, in fact, parallel corridors each of which is capable of accommodating a row of products aligned the ones behind the others, and limit of travel slides disposed towards the end of each of these corridors and against which the first products of each row abut, the position of these slides being variable according to the various corridors so that the fruits occupying one and the same position in the various rows are aligned along axes secant to the longitudinal axis of these rows.

Consequently, any change in size makes it necessary not only to modify the width of the various corridors, but also to set the position of each slide in such a way as to obtain a satisfactory distribution of the products. It should be noted, in addition, that these operations can produce setting errors and contribute, by this very fact, to a reduction in output of the packing device due to the need to correct such errors.

SUMMARY OF THE INVENTION

The present invention is aimed at overcoming this drawback and sets out to provide a packing device that permits this device to be adapted to various sizes of products in a few rapid and simple operations, where the possibilities of error during these operations are in addition very limited.

To this end, the invention provides a packing device of the type described in the above preamble, wherein:

each feed station comprises:

a conveyor belt extending along a descending slope starting from the transport means, and constructed so as to proceed in a longitudinal direction opposite to that in which the products are fed, so as to induce said products to undergo a rotating movement, a cradle having, in plan view, the general shape of a U with a width mating with that of the conveyor belt, which is provided with detachable fixing means capable of enabling it to be positively connected above said conveyor belt so that the products endowed with a rotating movement are distributed inside this cradle, said cradle having a frontal cross-piece and two lateral uprights provided internally with projecting lugs arranged in order to determine a distribution of the products in which the latter are aligned in rows respectively parallel with and at right angles to the lateral uprights of this cradle, the gripping means comprise:

two gripping heads each comprising a detachable lower support bearing a plurality of gripping members disposed according to a distribution identical to that of the products as determined by the cradle mounted on the feed station associated with said gripping head, means for pivoting the gripping heads which are capable of making them pivot about a horizontal axis between a position for gripping a layer of products, in which the gripping members extend along a plane parallel to that of the conveyor belts of the feed stations, and a position for depositing this layer of products, in which said gripping members extend along a horizontal plane, means for the horizontal displacement of the gripping heads which are capable of displacing each of them alternately, namely between a feed station for the container, purpose of gripping a layer of products and the packing station for the purpose of depositing this layer in a container, means for the vertical displacement of the gripping heads which are capable of displacing them in an independent manner between a top position suited to permitting their transfer between a feed station and the packing station, and bottom positions for respectively griping a layer of products and depositing this layer in a container, means for activating the gripping heads which are capable of switching them between an active state for the purpose of gripping a layer of products and transferring it towards the packing station, and a passive state for the purpose of depositing this layer of products in a container.

According to this packing device, the products are induced, square with each feed station, to spread out inside a volume defined by an interchangeable cradle as a function of the size of these products, which is provided internally with projecting lugs arranged in order to determine a suitable ordering of said products. In addition, these products are endowed with a rotating movement guaranteeing a positioning of these products the ones in contact with the others, without the risk of creating spaces not occupied by products.

Furthermore, any modification in the size simply requires, on the one hand, the changing of the cradles of the feed stations, this operation being rapid and easy given the facility of access to these cradles and not being a source of errors and, on the other hand, the changing of the support bearing the gripping members.

In practice, such an adjustment requires a very short time, which minimizes the period of immobilization of the packing device, and can be performed by any personnel without the need for specific qualifications.

According to another feature of the invention, the lugs of each cradle have external faces forming sections inclined with respect to the longitudinal axis of the conveyor belts. Such lugs have the advantage of permitting a good distribution of the products without the risk of damage to the latter.

In addition, each cradle comprises with advantage centering members projecting with respect to the uprights of said cradle, in proximity to its open face opposite the crosspiece, which are capable of forming a narrow entry point for the products which is capable of channelling them towards the central portion of this cradle.

Such centering members channel the stream of products towards the central portion of the cradles, thus facilitating the distribution of these products in the whole of the volume defined by said cradles.

According to another feature of the invention, the uprights and the crosspiece of the cradles are composed of section irons in the form of angles provided with a flange defining the filling volume of said cradles and with an external flange, the means for the detachable fixing of these cradles consisting in screwing members that are capable of permitting the external flange of the uprights to be positively connected to the frame of the conveyor belt.

All that is required for the fitting and dismantling of the cradles is thus simply to screw and unscrew some screwing members which provide the support of said cradles relative to the conveyor belts.

Furthermore, the gripping members are preferably composed of suction cups provided with an upper end which is in the form of a screw socket capable of allowing them to be positively connected below a support consisting of an interchangeable plate drilled with threaded bores arranged according to a distribution identical to that of the products as determined by the associated cradle, each gripping head comprising a suction tank provided with an open lower face of dimensions suited to being blocked off by the cup-bearing support which is connected to suction means capable of depressurizing said tank.

In addition, according to another feature of the invention:

the suction means comprise a central suction unit connected to the suction tanks of the gripping heads, and switching members capable of depressurizing alternately the one or the other of the suction tanks, the means for activating the gripping members comprise members for detecting the bottom position of the means for vertical displacement of the gripping heads, which are disposed on a level with the packing station and are connected to the switching members so as to produce a halt in the depressurizing of the tank of the gripping head disposed in said bottom position.

The gripping members are thus automatically deactivated when a gripping head is in bottom position square with the packing station, so as to produce the deposition of the layer of products which is borne by this gripping head, while simultaneously the gripping members of the other gripping head become active so as to permit the gripping of a layer of products disposed on a level with the corresponding feed station.

The vertical displacement means, for their part, preferably comprise, for each gripping head, a jack arranged vertically beneath said gripping head, which is capable, on the one hand, of raising said gripping head towards its top position during its spreading and maintaining it in this position in its spread state and, on the other hand, of permitting the descent of this gripping head during its retraction.

In addition, the detection members then comprise, with advantage, sensors capable of detecting the absence of contact between the gripping heads and the associated jack, square with the packing station, and producing a command for the spreading of this screw in the absence of such a contact.

Such sensors are capable of being triggered when the products borne by a gripping head come into contact either with the bottom of the container or with the upper layer disposed in this container, and they thus stop the descent of said gripping head, producing a breaking of the contact between the latter and the jack, the retraction of which is, for its part, not interrupted.

In addition, the switching members are with advantage under the control of the above-mentioned detection sensors. Thus, these sensors control two separate and simultaneous actions. They control, in fact, on the one hand the switching over of the central suction unit, and on the other the reversal of the movement of the jacks.

According to another feature of the invention, on the one hand the relative position of the packing station and the food stations, and on the other the means for horizontal displacement of the gripping heads, are suited to allowing said gripping heads to be displaced along a semi-circular path centered on a vertical axis about which are uniformly distributed said packing and feed stations.

The means for transporting the products, for their part, preferably comprise:

a longitudinal central conveyor belt for supplying a flow of products, two transverse conveyor belts extending between the downstream end of the central conveyor belt and the upstream ends of the conveyor belts of the feed stations, so as to form with the central conveyor belt a T-shaped transport line whose arms are formed by said transverse conveyor belts, which is suited to divide the flow of products into two streams, guiding members disposed above the transverse conveyor belts, which are suited to divert the products and delivering them towards the conveyor belts of the feed stations.

In addition, the operation of each transverse conveyor belt is with advantage under the control of members for detecting the degree of filling of the cradle supplied by this conveyor belt, which are suited stop the running of said conveyor belt for a predetermined degree of filling of said cradle.

Such detection members make it possible to interrupt the flow of products supplied towards the feed stations when the degrees of filling attain a predetermined value, thus avoiding an excessive afflux of products between two successive grippings of a layer of said products.

According to another feature of the invention, the packing station comprises a conveyor for supplying and removing the containers, which extends in a direction at right angles to that of the conveyor belts of the feed stations, the means for positioning said containers consisting in retractable stop means capable of interrupting the displacement of the containers in a predetermined position, in order to permit their filling.

In addition, this conveyor comprises with advantage two longitudinal and parallel endless chains, and longitudinal guide members arranged in order to support the upper sides of these chains so that said sides extend horizontally and effect the displacement of the containers positioned on said chains.

The stop means also comprise, with advantage, a stop disposed between the two chains and articulated with respect to the conveyor so as to be able to pivot between a raised position, in which it extends vertically, and a retracted position below the horizontal transport plane of said conveyor.

According to another feature of the invention relating to a device for packing containers such as cartons, the packing station comprises:

- a platform for raising the container which is in contact with the stop means, said stop means being capable of displacing said container between a top position, in which it is located above the plane of the conveyor, and a bottom position, in which it rests on this conveyor,
- means for expanding the upper edge of the container supported in top position by the lifting platform, which are capable of flattening themselves against the internal faces of the upper end of the lateral walls of this container, and of causing a perceptible expansion of said container.

This device allows the walls of the containers to be parted perceptibly so that the latter have an upper opening of slightly greater cross-section than that of the inside of said containers, thus facilitating the penetration of the gripping heads.

In addition, the expansion means preferably comprise four flaps disposed so as to define a volume of rectangular section mating with that of the containers, said flaps being borne by horizontal displacement means capable of positioning them:

- either in a position of minimum parting enabling said flaps, when a container is displaced towards its top position, to be induced to penetrate partially into this container without stressing the walls of the latter,
- or into a position of maximum parting in which said flaps each flatten themselves against a lateral wall of the container disposed in its top position, producing expansion of the latter.

BRIEF DESCRIPTION OF THE DRAWINGS

Other features, aims and advantages of the invention will emerge from the detailed description which follows with reference to the appended drawings, which represent a preferred embodiment of the latter as a non-limiting example. In these drawings, which are an integral part of the present description.

DETAILED DESCRIPTION OF THE INVENTION

Figure 1:
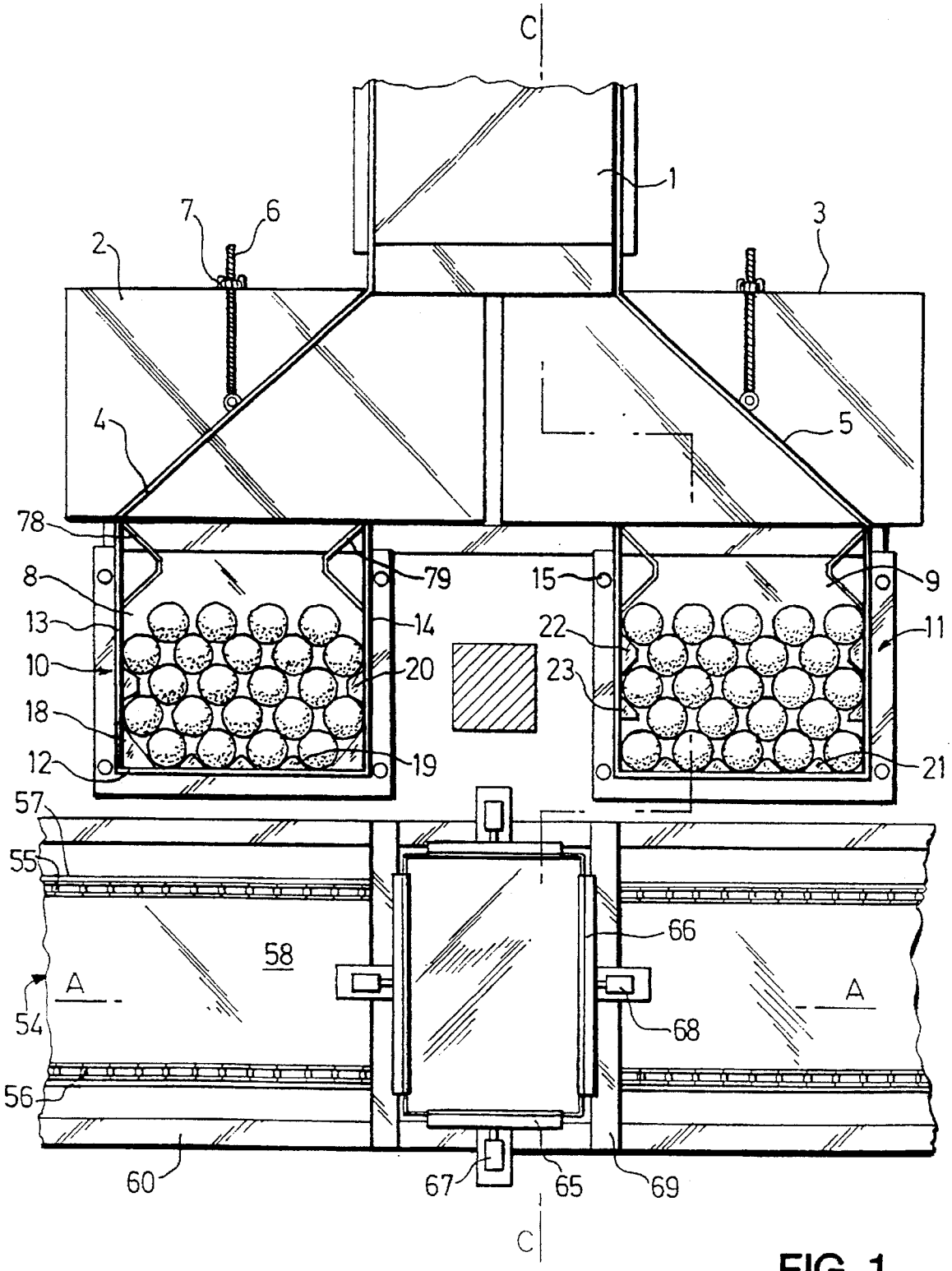
FIG. 1 is an overhead view of a packing device according to the invention, in which the gripping heads are not shown.

The device shown in FIGS. 1–4 and 6 is designed to effect automatically, from a flow of citrus fruits delivered in bulk, the filling of a carbon by means of alternating and superimposed layers of said citrus fruits.

This packing device comprises transport means capable of dividing the flow of citrus fruits such as oranges into two separate streams, two separate feed stations suited to arrange each stream of citrus fruits according to a predetermined distribution, a packing station comprising means for the automatic supply and removal of cartons and positioning means capable of providing a support for each carton for the purpose of filling it, and gripping means capable of gripping alternately a layer of citrus fruits square with each feed station and of affecting their transport towards the packing station.

First of all, the transport means comprise a longitudinal central conveyor belt 1 for supplying a flow of products, and two transverse conveyor belts 2, 3 disposed as a downstream continuation of the central conveyor belt 1, these three conveyor belts 1–3 are bounded laterally by slide rails. The relative disposition of these three conveyor belts 1–3 is suited to their forming a transport line in the form of a T whose arms are formed by the transverse conveyor belts 2, 3, which transport line is suited to divide the flow of products into two streams moving in opposite directions.

In addition, these transport means comprise guiding members disposed above the transverse conveyor belts 2, 3, which guiding members are suited to divert the course of the citrus fruits so as to deliver them towards the feed stations described below.

These guiding members comprise, for each transverse conveyor belt 2, 3, a cheek 4, 5 disposed diagonally with respect to said conveyor belt, so as to each extend from one of the lateral ends downstream of the central conveyor belt 1.

In addition, control means are suited to allow the angular position of these cheeks 4, 5 to be adopted. These control means comprise, for each cheek 4, 5, a screw rod such as 6, articulated towards one of its ends on said cheek and cooperating, towards its other end, with a wheel such as 7, borne by the frame of the corresponding transverse conveyor belt 1, 2.

Each feed station comprises, for its part, a longitudinal conveyor belt 8, 9, extending along a descending slope inclined at an angle ($\alpha$) with respect to a horizontal plane, which conveyor belt 8, 9 is arranged so as to be fed with citrus fruits by a transverse conveyor belt 2, 3.

For example, the slope ($\alpha$) of these conveyor belts 8, 9 can be of the order of 20 degrees for citrus fruits such as oranges.

In addition, these conveyor belts 8, 9 are induced to run in a longitudinal direction opposite to the direction in which the products are fed, so as to induce these products to undergo a rotating movement.

Each feed station comprises, in addition, cradles such as 10, 11 interchangeable as a function of the size of the citrus fruits, which have in plan view the shape of a U with a width mating with that of the conveyor belts 8, 9 and are arranged so as to be positively connected above said conveyor belts so that the products endowed with a rotating movement are distributed in an ordered manner inside said cradles.

Each of these cradles 10, 11 comprises a frontal crosspiece 12 and two lateral uprights 13, 14 composed of section irons in the form of angles provided with a flange defining the filling volume of said cradles, and with an upper external flange capable of being positively connected to the frame of the conveyor belts 8, 9 by means of screwing members, so as to determine a positioning of the cradles in which one of the uprights 13 forms a ramp extending as a continuation of a cheek 4, 5.

Figure 6:
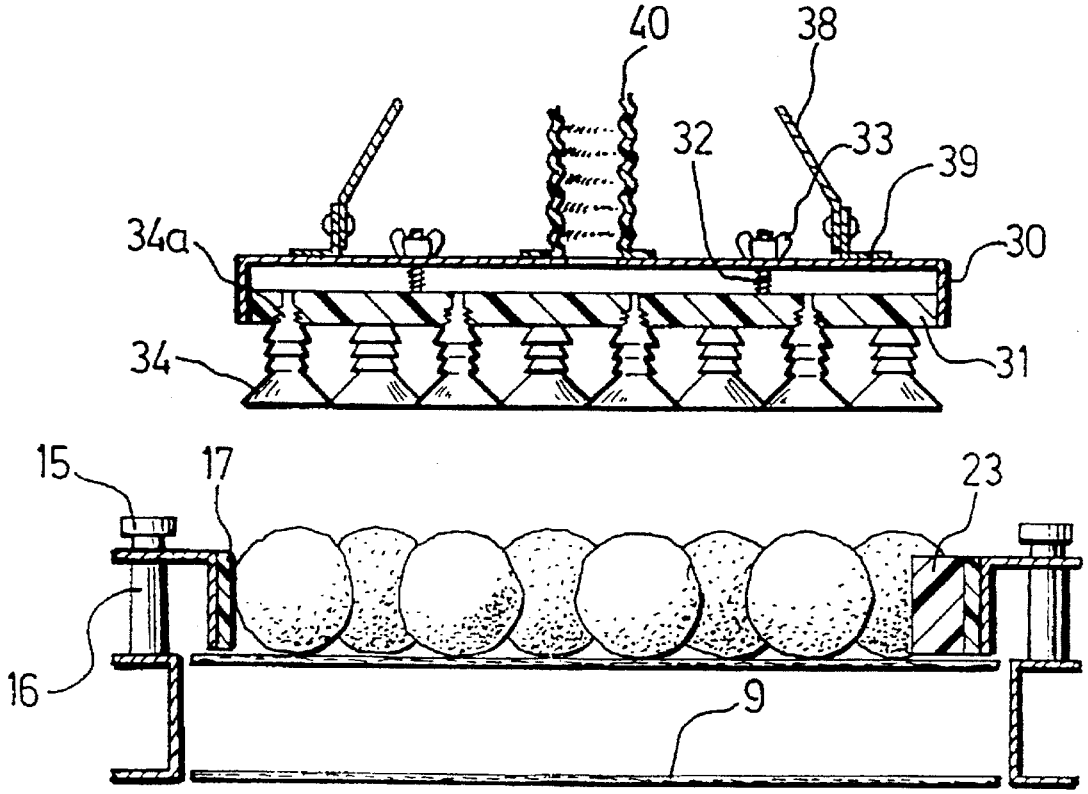

For example, and as shown in FIGS. 1 and 6, these screwing members consist of screws such as 15 designed to be screwed into tapped screw sockets such as 16 extending at right angles with respect to the frame of the conveyor belts 8, 9, so as to support the external flange of the uprights 13, 14 of the cradles 10, 11. In addition, these screws 15 are four in number and are disposed towards each of the longitudinal ends of the uprights 13, 14.

As shown in FIGS. 1 and 6, the uprights 13, 14 and crosspiece 12 of the cradles 10, 11 are lined internally with a plate such as 17 of a plastics material suited to not harm the citrus fruits. In addition, the frontal crosspiece 12 and the uprights 13, 14 are provided internally with projecting lugs, such as 18–23 (in FIG. 1), which are arranged in order to determine a distribution of the products in which the latter are aligned in rows respectively parallel with and at right angles to the uprights 13, 14.

The disposition of these lugs 18–20, which have sections inclined with respect to the internal face of the uprights 13, 14 and of the crosspiece 12, is a function of the size of the products and suited to the latter being arranged so as to form layers, on the one hand, alternating from one feed station relative to the other and, on the other, with dimensions mating with the section of the cartons.

Thus according to FIG. 1, the cradle 10 comprises lugs 18–20 disposed so as to obtain a front row of four citrus fruits then alternately rows of five citrus fruits and rows of four citrus fruits. The cradle 11, for its part, comprises lugs 21–23 disposed so as to obtain a front row of five citrus fruits then alternately rows of four citrus fruits and rows of five citrus fruits.

Figure 5:
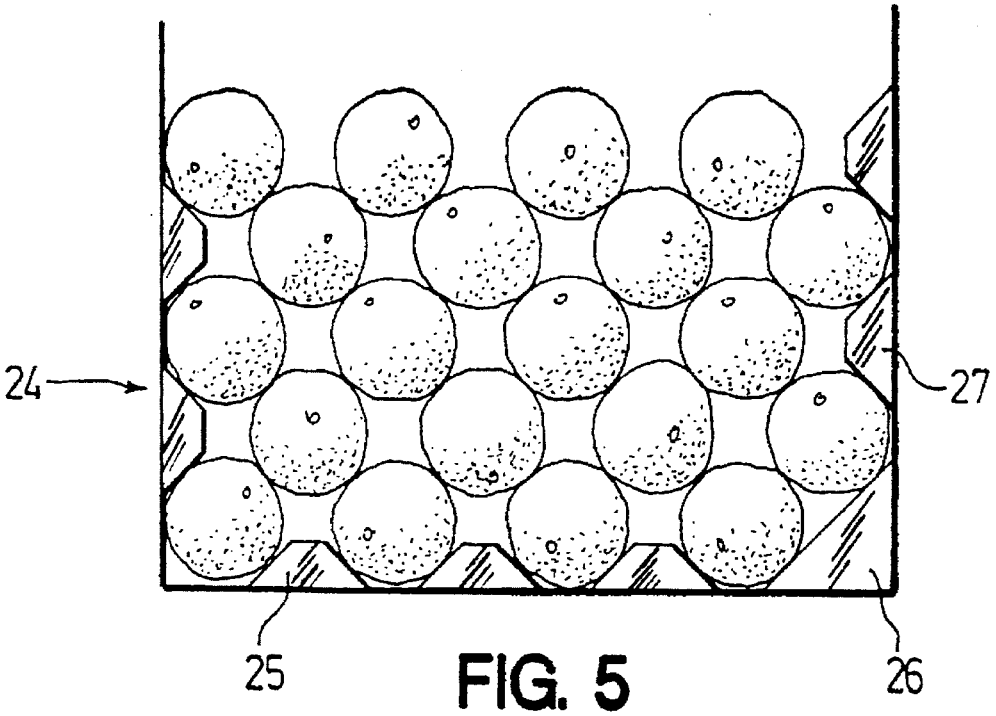
FIG. 5 is a top view of a cradle variant designed for a size of products which are different from those shown in FIGS. 1 to 4 and, FIG. 6 is a cross-section through a plane inclined by an angle ($\alpha$) with respect to a horizontal plane, representing a gripping head disposed directly below a feed station.

As a variant, FIG. 5 shows a cradle 24 whose lugs 25–27 are disposed so as to obtain rows of four citrus fruits, the citrus fruits of each row being staggered transversely with respect to those of the neighbouring rows.

It will be appreciated that these dispositions and shapes of the lugs 18–23, 25–27 are given as examples and are calculated initially for each type of size.

Finally, each cradle 10, 11 comprises centering members 78, 79 projecting with respect to the uprights 13, 14, in proximity to the open face of these cradles, which are suited to forming a narrow inlet capable of channelling the products towards the central portion of said cradles.

These centering members have, in plan view, the form of dihedra 78, 79 disposed opposite each other and positively connected on a level with their base with the uprights 13, 14 of the cradles 10, 11.

Finally, each feed station comprises sensors (not shown) for detecting the degree of filling of the cradles 10, 11, which are suited to stop the running of the transverse conveyor belts 2, 3 associated with these cradles 10, 11 for a predetermined degree of filling of said cradles.

If FIG. 1 is consulted, where each layer gripped for the purpose of filling the cartons comprises four transverse rows of products, the sensors are, for example, suited to stop the running of the transverse conveyor belts 2, 3 when five rows of products are arranged inside the cradles 10, 11. It should be noted, in addition, that the operation of the central conveyor belt 1 is preferably under the control of that of the transverse conveyor belts 2, 3, so as to stop the running of this central conveyor belt 1 in the event of a stoppage of these transverse conveyor belts 2, 3.

The gripping means comprise, for their part, two gripping heads 28, 29 each constructed in order to effect the transfer of layers of products between a feed station and the packing station.

These gripping heads 28, 29 each comprise an upturned tank 30 forming a suction chamber and having an oblong parallelepiped shape of little height, and an interchangeable rectangular plate 31 bearing the gripping members and having dimensions suited to block off tightly the internal face of the tank 30.

The fixing of each plate 31 is in addition realized by means of two screws such as 32 arranged to extend through openings made in the upper wall of the tank 30 and to be fixed by means of nuts 33.

The gripping members borne by this plate 31 consist moreover of suction cups with bellows, such as 34, of the conventional kind, having towards their upper end a screw socket **34*a* capable of allowing them to be screwed into threaded bores made in said plate according to a distribution identical to that of the products as determined by the associated cradle 10, 11**.

These gripping heads 28, 29 are suspended below brackets 35, 36 disposed so as to extend in two orthogonal vertical planes. These brackets 35, 36 each comprise a tubular frame, such as 37, having the form of a right-angled triangle, the two sides defining the right angle of which extend respectively vertically and horizontally. They also comprise a vertical frame, such as 38, of trapezoid shape, extending below the base of these brackets 35, 36, directly below the top of said brackets, which is opposite the right angle, said frame being articulated, on a level with the lower ends of its uprights, on two tabs such as 39 integral with the upper wall of the tank 31 so as to permit the gripping heads 28, 29 to pivot about a horizontal axis.

This pivoting is effected, for each gripping head 28, 29, by means of a jack such as 71 articulated respectively on the base **37*a* of the tubular frame 37 and on the upper wall of the tank 31, and suited to determine two inclination positions: one position for gripping the layers of products in which the base of the suction cups 34 extends in a plane inclined at an angle ($\alpha$) with respect to the horizontal, and a position for depositing these layers in which the base of the suction cups 34** extends in a horizontal plane.

Finally, concerning the gripping heads 28, 29, the latter are connected to a central suction unit (not shown) by flexible tubes such as 40, which are suited to issue into the tanks 31 so as to depressurize alternately the one or the other of said tanks.

The brackets 35, 36 are, for their part, mounted so as to slide along a vertical post composed of two vertical section irons of rectangular cross-section 41, 42 suited to being able to pivot the one relative to the other about a vertical axis: a fixed section iron 41, and a moving section iron 42 mounted so as to pivot in bearings with vertical axes, such as 43, borne by the fixed section iron 41.

To permit their sliding, these brackets 35, 36 are each provided with two guide columns, such as 44, parallel with the vertical upright 37*b* of the tubular frame 37 and disposed opposite the external face of this upright 37*b*, said columns being capable of sliding relative to a shoe 45 provided with two mating vertical thru bores, which is integral with one of the external faces of the moving section iron 42 of the post. In addition, the two shoes 35, each associated with a bracket 37, are positively connected to two contiguous orthogonal faces of the moving section iron 42 of the post, so that a rotation by 90 degrees of the latter effects a corresponding pivoting of the gripping heads 28, 29, thus bringing the latter either directly below a cradle 10, 11 or directly below a carton.

The vertical displacements of the brackets 37 are moreover engendered for each of these brackets 37 by means of a jack 46, 47 arranged vertically, the body of which is integral with the moving section iron 42 of the post, towards the lower end of the latter, and whose rod is suited to come into contact with the lower face of the base 37*a* of the corresponding tubular frame 37.

Each of these jacks 46, 47 is moreover suited to allow the assembly of brackets 35, 36 and gripping heads 28, 29 to descend during its retraction, and to induce this assembly to ascend during its spreading.

In addition, each of these jacks 46, 47 is associated with an inductive sensor capable of detecting the absence of contact between the rod of said jack and the base 37*a* of the tubular frame 37 of the bracket 35, 36, said sensor being suited to an absence of contact concerning the gripping means disposed directly below the packing station leading to actuating with a time delay, a reversal of the movement of the two jacks 46, 47, and hence to actuating the spreading of these jacks.

Furthermore, these inductive sensors are also connected to switching members associated with the central suction unit so as to engender a switching over of the connection between this central suction unit and the tanks 31 of the gripping heads 28, 29, the switching over having the effect of interrupting the suction in the tank 31 situated square with the packing station and of depressurizing the tank 31 situated square with a feed station.

Thus, since the absence of contact occurs when the layer of products borne by the gripping head 28 (or 29) situated square with the packing station comes into contact with the bottom of the carton or with the higher layer of products deposited previously in this carton, the reversal of actuation is therefore carried out automatically, on the one hand after this layer of products has been deposited, because of the deactivation of the suction cups 34 borne by this gripping head 28 (or 29), and on the other hand after a layer of products has been gripped by the other gripping head 29 (or 28), because of the activation of the suction cups 34 of the latter.

Figures 2, 3:
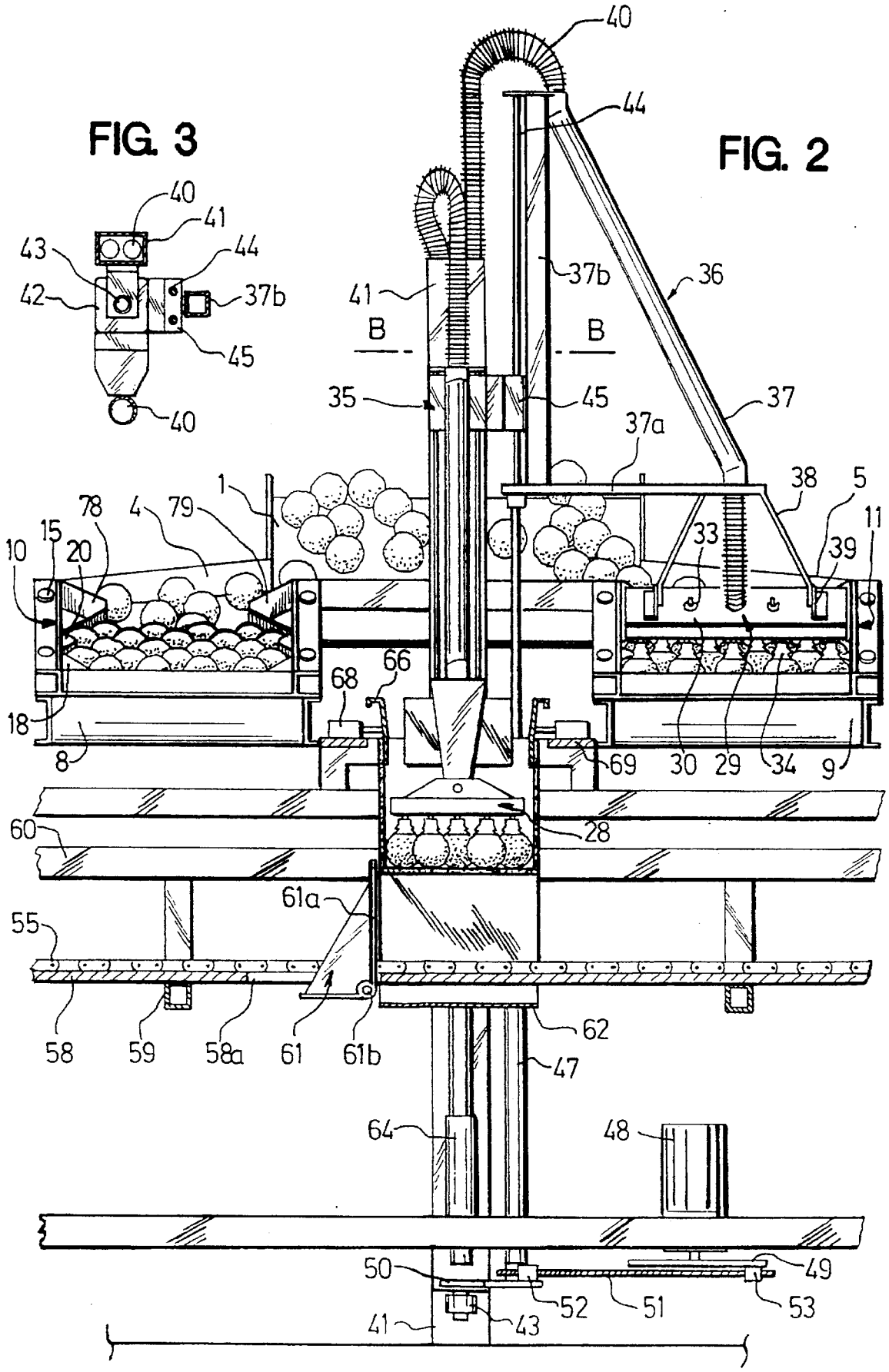
FIG. 2 is a cross-section of the latter, square with the packing station, through a vertical plane A.
FIG. 3 is a section through a horizontal plane B, square with the means for the horizontal displacement of the gripping members.
Figure 4:
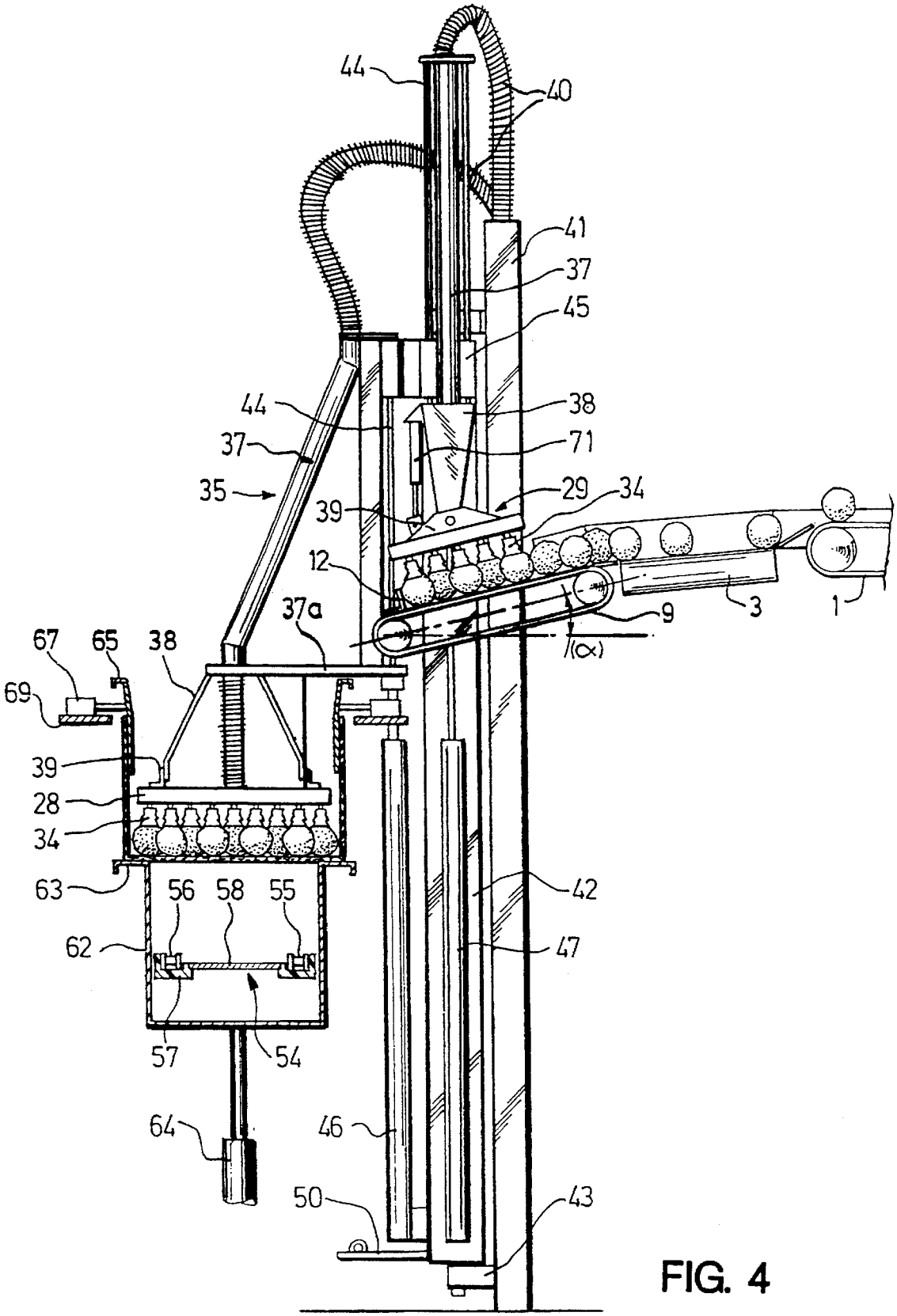
FIG. 4 is a longitudinal section of the latter through an interrupted vertical plane C.

The means for pivoting the moving section iron 42 of the post relative to the fixed section iron 41 of this post comprise, finally, a motor 48 disposed so that its drive shaft extends vertically, said drive shaft being connected to said moving section iron by a linkage of the connecting rod-shank system type capable of making it pivot between two positions offset by 90 degrees. As shown in FIG. 2, this linkage comprises a plate 49 coaxial with the drive shaft and arranged so as to be moved in rotation by the latter, a horizontal tab 50 extending obliquely with respect to one of the faces of the moving section iron 42, and a worm-type reduction gear 51 cooperating with screw sockets 52, 53 articulated with respect to said plate and said tab so as to be able to pivot about a vertical axis.

The packing station comprises, for its part, firstly and as indicated above, a conveyor 54 for supplying and removing the cartons. This conveyor 54 comprises two longitudinal and parallel endless chains 55, 56, the top sides of which, suited to support the cartons, extend in longitudinal guides such as 57 connected by a horizontal plate 58, the whole being mounted on a frame represented in a general way as 59, forming a cradle and provided with longitudinal ramps such as 60 effecting the lateral guiding of the cartons.

This conveyor 54 comprises, in addition, a stop 61 for positioning each carton directly below the gripping heads 28, 29. This stop 61 is in the form of an angle iron disposed between the two chains 55, 56 and accommodated in an opening 58*a* made in the plate 58, said angle iron being capable of pivoting about a transverse horizontal axis 61*b* between two positions: a retracted position permitting displacement of the cartons, in which the stop flange 61*a*, of this angle iron lies flush with the plate 58, and a raised position (shown in FIG. 2) in which this flange 61*a* extends vertically above said plate.

The conveyor 54 also comprises a platform 62 for raising the carton positioned by the stop 61, which is suited to lift said platform relative to the conveying plane towards a filling position (shown in FIGS. 2 and 4) in which the upper edge of this carton is located perceptibly below the horizontal plane passing through the upstream ends of the conveyor belts 8, 9 of the feed stations.

This platform 62 is transversely in the form of a U with a width suited to frame the conveyor, and comprises two horizontal and longitudinal upper returns such as 63 which are arranged to come into lower contact with the surface portions of the bottom of the cartons and are situated as a lateral overhang with respect to said conveyor.

The lateral displacements of this platform 62 are, in addition, effected by a pressure cylinder 64 arranged vertically below said platform.

The conveyor 54 also comprises means for the expansion of the upper edge of the carton maintained in filling position by the platform 62, which are suited to flatten themselves against the internal faces of the walls of this carton, and to cause a perceptible expansion of the upper part of the latter.

These expansion means comprise four flaps such as 65, 66 disposed so as to define a rectangular volume with a section mating with that of the cartons, said flaps each being fixed to the rod of a pressure cylinder such as 67, 68 arranged horizontally, the body of which is mounted on one of the crosspieces of a horizontal frame 69 disposed above the conveyor 54, in the axis of the platform 62, and borne by the frame 59 of said conveyor.

Such flaps 65, 66 are suited to being displaced horizontally by the associated jacks 67, 68 between two positions: a position of minimum parting permitting the flaps to penetrate partially into a carton without stressing the walls of the latter, when said carton is raised towards its filling position, and a position of maximum parting in which said flaps flatten themselves against the walls of the carton, thus causing a perceptible expansion of the latter.

These flaps 65, 66 have, in addition, longitudinally, on the one hand a higher strip of surface inclined with respect to a vertical plane, which is suited to form a centering slide rail of decreasing section relative to the direction of descent of the gripping heads 28, 29, and on the other hand a vertical lower strip of surface capable of flattening itself against the walls of the carton.

In addition to the control means described above (sensors for detecting the degree of filling of the cradles 10, 11, inductive sensors associated with the jacks (46, 47 . . . ), the packing device is also provided, in conventional manner, with all control and feed means capable of automating the various stages in the supplying, filling and removal of the cartons.

I claim:

1. An automatic packing device for filling containers with superimposed layers of products, comprising:

means for transporting a flow of products delivered in bulk and for dividing said flow into two separate streams, two separate feed stations including means for arranging each stream of products so that said products are aligned one behind another in parallel rows, a central packing station comprising support means for positioning each container during filling, gripping means for alternately gripping a number of products forming a layer, and for placing said layer in said container so as to fill said container with superimposed layers of products, said gripping means being dimensioned to fit within the container, wherein each feed station comprises:

a conveyor belt extending along a descending slope from the transporting means in a direction opposite to the direction in which the products are fed, so as to induce said products to undergo a rotating movement, a U-shaped cradle comprising two vertical members connected by a horizontal crosspiece which together define an open face, said cradle having a width substantially matching the width of the conveyor belt, said cradle further including fixing means for detachably connecting said cradle above said conveyor belt so that the products exhibiting a rotating movement are distributed inside said cradle, projecting lugs positioned inside the cradle for aligning the products in parallel rows inside the cradle, the gripping means comprise:

two gripping heads each comprising a detachable lower support bearing a plurality of gripping members disposed according to a distribution identical to the distribution of the products in the cradle, means for pivoting the gripping heads about a horizontal axis between a first position for gripping a layer of products, and a second position for depositing said layer of products, means for horizontally displacing the gripping heads alternately between a feed station for gripping a layer of products and the packing station for depositing said layer in a container, means for vertically displacing the gripping heads between a top position for transfer between a feed station and the packing station, and bottom positions for respectfully gripping a layer of products and depositing said layer in a container, means for activating the gripping heads between an active state for gripping and transferring a layer of products towards the packing station, and a passive state for depositing said layer of products in a container.

2. A packing device according to claim 1, wherein the lugs of each cradle have external faces forming sections inclined with respect to the conveyor belts.

3. A packing device according to claim 1, wherein each cradle further comprises centering members projecting with respect to the vertical members, in proximity to its open face opposite the horizontal crosspiece, said centering members forming a narrow entry point for channeling the products towards a central portion of said cradle.

4. A packing device according to claim 1, wherein the vertical members and the crosspiece of the cradles are comprised of section irons in the form of angles provided with a flange defining the filling volume of said cradles, and with an external flange, said fixing means consisting of screwing members for connecting the external flange to a frame of the conveyor belt.

5. A packing device according to claim 1, wherein the gripping members are comprised of suction cups having an upper end which is in the form of a screw socket for connection to the lower support, said lower support consisting of an interchangeable plate drilled with threaded bores arranged according to a distribution identical to the distribution of the products in the cradle, each gripping head comprising a suction tank having an open lower face adapted to being blocked off by a cup-bearing support connected to suction means.

6. A packing device according to claim 5, wherein:

the suction means comprise a central suction unit connected to the suction tanks of the gripping heads, and switching members for alternately depressurizing each suction tank, the means for activating the gripping members comprise detection members for detecting the bottom position of the means for vertically displacing the gripping heads, which are disposed on a level with the packing station and are connected to the switching members so as to produce a halt in the depressurizing of the suction tank of the gripping head disposed in said bottom position.

7. A packing device according to claim 6, wherein the means for vertically displacing the gripping heads comprise, for each gripping head, a jack vertically disposed beneath said gripping head for raising said gripping head toward a top position during extension, and for lowering said gripping head during retraction.

8. A packing device according to claim 7, wherein the detection members comprise sensors for detecting the absence of contact between the gripping heads and the associated jack, and for actuating the extension of said jack in the absence of such contact.

9. A packing device according to claim 8, wherein the switching members are connected to the sensors.

10. A packing device according to claim 1, wherein the relative positions of the packing station, the feed stations, and the means for horizontally displacing the gripping heads, are such that said gripping heads are displaceable along a semi-circular path centered on a vertical axis about which the packing and feed stations are uniformly distributed.

11. A packing device according to claim 10, wherein the gripping heads are borne by brackets extending in orthogonal vertical planes, said brackets being integral with a central post associated with means for setting said post in rotation about a vertical axis.

12. A packing device according to claim 1, wherein the means for transporting the flow of products comprise:

a central conveyor belt, two transverse conveyor belts extending between a downstream end of the central conveyor belt and upstream ends of the conveyor belts of the feed stations, so as to form with the central conveyor belt a transport line in the form of a T whose arms are formed by said transverse conveyor belts, said transport line dividing the flow of products into the two separate streams, guiding members disposed above the transverse conveyor belts for diverting the products towards the conveyor belts of the feed stations.

13. A packing device according to claim 12, wherein the guide members comprise, for each transverse conveyor belt a cheek disposed diagonally above said transverse conveyor belt, so as to extend between one of the lateral ends downstream of the central conveyor belt and the lateral end upstream opposite the open face of the corresponding cradle, each of said cheeks being operatively associated with means for setting its angular position.

14. A packing device according to claim 12, wherein each transverse conveyor belt comprises sensing means for detecting the degree of filling of the cradle fed by a transverse conveyor belt, said sensing means including means for stopping movement of said transverse conveyor belt for a predetermined degree of filling of said cradle.

15. A packing device according to claim 1, wherein the packing station comprises conveyor means for supplying and removing the containers, said conveyor means extending in a direction at right angles to the direction of the conveyor belts of the feed stations, the support means for positioning said containers consisting of retractable stop means for interrupting displacement of the containers at a predetermined position, in order to permit their filling.

16. A packing device according to claim 15, wherein:

the conveyor means comprises two parallel endless chains, and guide members for supporting upper sides of the chains so that said sides extend horizontally and effect the displacement of the containers positioned on said chains, the stop means comprise a stop disposed between the two chains and articulated with respect to the conveyor means so as to pivot between a raised position, in which said stop extends vertically, and a retracted position below the conveyor means.

17. A packing device according to claim 16, wherein the packing station comprises:

a platform for raising the container which is in contact with the stop to a top position in which said container is located above the conveyor means, and a bottom position in which said container rests on said conveyor means, expansion means for expanding an upper edge of the container supported in the top position by the platform, said expansion means including means for flattening themselves against internal faces of an upper end of lateral walls of said container, and for causing a perceptible expansion of said container.

18. A packing device according to claim 17, wherein the expansion means comprise four flaps disposed so as to define a volume of rectangular section matching the volume of the containers, said flaps being borne by horizontal displacement means for positioning them either in a position of minimum parting enabling said flaps to penetrate partially into said container without stressing the walls of the container, or into a position of maximum parting in which said flaps each flatten themselves against a lateral wall of the container disposed in its top position, thereby producing expansion of the container.

* * * * *